US008072148B2

(12) United States Patent
Iwai

(10) Patent No.: US 8,072,148 B2
(45) Date of Patent: Dec. 6, 2011

(54) FLUORESCENT LAMP DRIVING DEVICE AND LIQUID CRYSTAL DISPLAY APPARATUS USING THE SAME

(75) Inventor: Kenji Iwai, Kanagawa (JP)

(73) Assignee: Sony Corporation, Tokyo (JP)

( * ) Notice: Subject to any disclaimer, the term of this patent is extended or adjusted under 35 U.S.C. 154(b) by 437 days.

(21) Appl. No.: 12/413,674

(22) Filed: Mar. 30, 2009

(65) Prior Publication Data

US 2009/0243491 A1 Oct. 1, 2009

(30) Foreign Application Priority Data

Mar. 31, 2008 (JP) ..... 2008-092844

(51) Int. Cl.
*H05B 39/00* (2006.01)
*H05B 39/04* (2006.01)

(52) U.S. Cl. ..... 315/98; 315/105; 315/106; 315/116; 315/287; 345/102; 336/222; 336/221

(58) Field of Classification Search ..... 315/94–99, 315/101, 105–107, 112–11, 209 R, 225, 224, 315/176, 279, 287, 307, 291; 336/221, 222; 345/102, 76, 87, 74.1
See application file for complete search history.

(56) References Cited

U.S. PATENT DOCUMENTS 6,211,619 B1 * 4/2001 Nilssen ..... 315/106
6,324,081 B1 * 11/2001 Sakamoto et al. ..... 363/25
7,436,128 B2 * 10/2008 Cheng et al. ..... 315/291
7,514,878 B2 * 4/2009 Crandall et al. ..... 315/224
7,696,702 B2 * 4/2010 Iwai ..... 315/276

FOREIGN PATENT DOCUMENTS

| | | |
|---|---|---|
| JP | 63-190297 | 8/1988 |
| JP | 64-003996 | 1/1989 |
| JP | 02-276195 A | 11/1990 |
| JP | 06-045079 | 2/1994 |
| JP | 08-017581 A | 1/1996 |
| JP | 2001-185383 A | 7/2001 |
| JP | 2001-338790 | 12/2001 |
| JP | 2003-249391 A | 9/2003 |

* cited by examiner

*Primary Examiner* — Vibol Tan
(74) *Attorney, Agent, or Firm* — Wolf, Greenfield & Sacks, P.C.

(57) ABSTRACT

A fluorescent-lamp-driving device contains a driving control circuit that receives direct current power voltage and a lamp control signal for performing drive control on fluorescent lamps and converts the direct current power voltage to alternating current power voltage, and a transformer containing a winding at its primary side and windings for driving a heater and for maintaining discharge at its secondary side. The alternating current power voltage is supplied to heaters of the fluorescent lamps at their high electric potential side. The driving control circuit increases the frequency of the alternating current power supply to a frequency thereof in which voltage of the fluorescent lamps is equal to a discharge start voltage of the fluorescent lamps or less based on the lamp control signal at a period of starting-up time of the fluorescent lamps.

9 Claims, 8 Drawing Sheets

100
10
S11
S12
DRIVING CONTROL CIRCUIT
DC POWER SUPPLY
(HIGH VOLTAGE)
S14
TRANSFORMER FOR INVERTER
20
HEATER CONTROL UNIT OF
HIGH ELECTRIC POTENTIAL SIDE
30
S13
L1
IL
IL
IL
IL
L2
L3
L4
S42
S41
HEATER CONTROL UNIT OF
LOW ELECTRIC POTENTIAL SIDE
40
41
CURRENT DETECTION PORTION
DC POWER
(LOW VOLTAGE)

LAMP LOAD CURRENT

DRIVING PULSE SIGNAL S14 TO HEATERS OF HIGH VOLTAGE SIDE

DRIVE FREQUENCY f OF TRANSFORMER FOR INVERTER

200
Sin
50
LIQUID CRYSTAL DRIVER
S50
60
LIQUID CRYSTAL DISPLAY UNIT
10
DRIVING CONTROL CIRCUIT
S11
S12
COMMERCIAL POWER SUPPLY
70
DC12V
POWER SUPPLY UNIT
DC390V
S14
TRANSFORMER FOR INVERTER
20
HEATER CONTROL UNIT OF HIGH ELECTRIC POTENTIAL SIDE
30
S13
L1
IL
L2
L3
L4
S41
S42
40
HEATER CONTROL UNIT OF LOW ELECTRIC POTENTIAL SIDE
41
CURRENT DETECTION PORTION
100

FLUORESCENT LAMP DRIVING DEVICE AND LIQUID CRYSTAL DISPLAY APPARATUS USING THE SAME

BACKGROUND OF THE INVENTION

1. Field of the Invention

The present invention relates to fluorescent-lamp-driving device that is applicable to a backlight device driving a plurality of hot cathode fluorescent lamps (HCFL), and a liquid crystal display apparatus using the same.

2. Description of Related Art

The backlight device has recently been used in a liquid crystal television or a liquid crystal monitor using a large-scaled liquid crystal display panel. As light source of the backlight device, fluorescent lamps such as a plurality of cold cathode fluorescent lamps (CCFL), a plurality of external electrode fluorescent lamps (EEFL), or LED elements arranged like grid array are often used. As the fluorescent lamps, a plurality of HCFLs each having heaters may have also been used other than CCFL and EEFL.

HCFL has the same structure as that of fluorescent light tube used in a widely distributed lighting apparatus or the like for consumer electrical appliances and has excellent color reproductivity, good luminance efficiency and low applied voltage so that it has excellent characteristics as compared with those of CCFL. HCFL, however, may be necessary for heaters of both the end of the lamp so that it has a complex circuit, which results in high costs. This is because HCFL has not often used in the liquid crystal display. The fluorescent lamp generally contains fluorescent-lamp-driving device because the fluorescent lamp is driven by an alternating current. The fluorescent-lamp-driving device has often a function such that its output current is controlled so as to become a constant and keep its luminance constant even if input direct current voltage varies or impedance of the fluorescent lamp varies.

FIG. 1 shows a configuration of a backlight device 1 related to a related art using n pieces of HCFLs. The backlight device 1 shown in FIG. 1 contains a driving control circuit 2, a driving circuit 3 of high voltage side, a driving circuit 4 of low voltage side, a transformer 5 for inverter, two heater transformers HT1 and HT2 of high voltage side, n pieces of heater transformers LTi (i=1 to n) and n pieces of balance transformers BTi (i=1 to n).

The driving control circuit 2 is connected with a primary winding w1 of the transformer 5 for the inverter. A secondary winding w3 of the transformer 5 for the inverter is connected with heaters Hh1, Hh3, . . . , Hhn−1 of high voltage side of odd-numbered fluorescent lamps L1, L3, . . . , Ln−1 in parallel. A secondary winding w2 of the transformer 5 for the inverter is connected with heaters Hh2, Hh4, . . . , Hhn of high voltage side of even-numbered fluorescent lamps L2, L4, . . . , Ln in parallel. The transformer 5 for inverter supplies alternate current voltage having a predetermined operating frequency that may be necessary for discharging.

The driving circuit 3 of high voltage side drives the heaters Hh1, . . . , Hhn of high voltage side via the heater transformers TH1 and TH2 of high voltage side with the fluorescent lamps being divided into two groups of the odd-numbered fluorescent lamps L1, L3, . . . , Ln−1, and the even-numbered fluorescent lamps L2, L4, . . . , Ln in order to equalize luminance of n pieces of fluorescent lamps L1, . . . , Ln. Thus, the driving circuit 3 of high voltage side is connected with the heater transformers HT1 and HT2 of high voltage side. The heater transformer TH1 of high voltage side is connected with the heaters Hh1, Hh3, . . . , Hhn−1 of high voltage side of odd-numbered fluorescent lamps L1, L3, . . . , Ln−1 in parallel. The heater transformer TH1 of high voltage side supplies the heaters Hh1, Hh3, . . . , Hhn−1 of high voltage side of odd-numbered fluorescent lamps L1, L3, . . . , Ln−1 with heater power.

The heater transformer TH2 of high voltage side is connected with the heaters Hh2, Hh4, . . . , Hhn of high voltage side of even-numbered fluorescent lamps L2, L4, . . . , Ln in parallel. The heater transformer TH2 of high voltage side supplies the heaters Hh2, Hh4, . . . , Hhn of high voltage side of even-numbered fluorescent lamps L2, L4, . . . , Ln with heater power.

The driving circuit 4 of low voltage side is connected with a primary side of each of n pieces of the heater transformers LTi (i=1 to n) and supplies the heaters Hl1, . . . , Hln of low voltage side of n pieces of fluorescent lamps L1, . . . , Ln with heater power. A secondary side of the heater transformer LT1 of low voltage side is connected with the heater Hl1 of low voltage side of the fluorescent lamp L1. A secondary side of the heater transformer LT2 of low voltage side is connected with the heater Hl2 of low voltage side of the fluorescent lamp L2. Similarly, a secondary side of the heater transformer LTn of low voltage side is connected with the heater Hln of low voltage side of the fluorescent lamp Ln.

The balance transformer BT1 for detection of lamp current is connected with a terminal of the heater Hl1 of low voltage side of the fluorescent lamp L1. The balance transformer BT2 therefor is connected with a terminal of the heater Hl2 of low voltage side of the fluorescent lamp L2. Similarly, the balance transformer BTn therefor is connected with a terminal of the heater Hln of low voltage side of the fluorescent lamp Ln.

A terminal of a secondary side of the balance transformer BT1 is connected with a terminal of a secondary side of the other balance transformer BT2 in series. The other terminal of the secondary side of the balance transformer BT2 is connected with a terminal of a secondary side of the other balance transformer BT3 in series. Similarly, the secondary side of the balance transformer BTn is connected with a terminal of a terminal of the heater Hln of low voltage side of the fluorescent lamp Ln. The n pieces of balance transformers BT1, . . . , BTn detects lamp load current that runs in each of n pieces of fluorescent lamp L1, . . . , Ln serially and outputs a lamp current detection signal S4 indicating a sum total of the lamp load current by the n pieces of fluorescent lamp L1, . . . , Ln. The backlight device 1 having such a configuration can control luminance of the n pieces of fluorescent lamp L1, . . . , Ln so as to become a constant based on the lamp current detection signal S4, so that it is possible to construct a liquid crystal display apparatus having characteristics such as an excellent color reproductivity, good luminance efficiency and low applied voltage which are excellent ones as compared with those of CCFL or the like.

Japanese Patent Application Publication No. S63-190297 has disclosed on page 3 and FIG. 1 a discharge-lamp-lighting device. The discharge-lamp-lighting device contains a timer circuit, an inverter circuit, a current-limiting element and pre-heating circuit. The timer circuit is connected with an electric power supply and a control signal is output after a set period of time has been elapsed from a point of power-on time. The inverter circuit is connected with the timer circuit and the discharge lamp is connected with the inverter circuit through the current-limiting element. The inverter circuit includes at least one of pre-heating winding which supplies the discharge lamp with low voltage such that the discharge does not start based on the control signal during the set period of time from a point of power-on time.

After the set period of time has been elapsed from the point of power-on time, the inverter circuit supplies the discharge lamp with high voltage such that the discharge can start based on the control signal. On the assumption of this, the pre-heating circuit includes a voltage detection device and is connected with the pre-heating winding of the inverter circuit so that it detects that output voltage of the pre-heating winding is low and pre-heats electrodes of the discharge lamp. The apparatus having such a configuration can combine the timer circuit (lighting circuit) and the pre-heating circuit as one piece of power circuit, which enables the lighting device to be downsized and to be reduced in weight.

Japanese Patent Application Publication No. H06-045079 has disclosed on page 2 and FIG. 1 a luminescent-lamp-lighting device. The luminescent-lamp-lighting device contains a transistor inverter having a resonance circuit and an output transformer, and a filament pre-heating member. A switching transistor is connected with a direct current power supply and by switch operation of this transistor, an alternate current voltage generated in the resonance circuit is output to the output transformer. The output transformer is connected with a luminescent lamp. On the assumption of this, the filament pre-heating member limits operating frequency of the switching transistor to an operating frequency such that it is difficult to start the luminescent lamp because the filament is pre-heated until a set period of time has been elapsed from a point of direct-power-on time. After the set period of time has been elapsed from the point of direct-power-on time, the filament pre-heating member changes the operating frequency of the switching transistor to an operating frequency such that the luminescent lamp can start. The device having such a configuration enables blackening due to cold start of the luminescent lamp, shortening of lift time of the luminescent lamp or the like to be prevented.

Japanese Patent Application Publication No. 2001-338790 has disclosed on page 3 and FIG. 1 a discharge-lamp-lighting device and an illumination apparatus. The discharge-lamp-lighting device contains a direct-current power supply, first and second switching members, resonance inductance, resonance capacitance, a drive resonance circuit, temperature-sensitive resistor, and a drive signal generation circuit of feed-back type. The first and second switching members are connected to each other in series and are connected with the drive signal generation circuit. The resonance inductance is connected with the drive signal generation circuit. The discharge lamp is connected with the resonance inductance. First resonance capacitance is connected with electrodes of the discharge lamp and the electrodes of the discharge lamp are connected with the direct-current power supply through second resonance capacitance.

According to this discharge-lamp-lighting device, the discharge lamp is driven based on high frequency alternating current generated by the alternative switching operations by the first and second switching. The drive resonance circuit resonates based on feed-backed voltage generated at the resonance inductance that feeds back the current flown through the discharge lamp. On the assumption of this, the temperature-sensitive resistor is connected with the drive resonance circuit and resonance frequency of the drive resonance circuit varies in succession at a point of power-on time. The drive signal generation circuit controls the first and second switching members so as to switch them on alternatively based on the resonance voltage of the drive resonance circuit.

The discharge-lamp-lighting device having such a configuration can start the operation of discharge lamp after pre-heating the filament electrodes at a point of power-on time, thereby improving a feature of switching the discharge lamp on and off. At the same time, the temperature-sensitive resistor connected with the drive resonance circuit operates at a relative low voltage so that reliability thereof can be improved.

SUMMARY OF THE INVENTION

If, however, the backlight device having a plurality of HCFLs under the almost same configuration as that of CCFL is realized by applying the fluorescent-lamp-driving device according to related art, a ratio between a period of operating time and a period of stopping time in the fluorescent lamps L1 through Ln considerably varies by adjusting luminance of the fluorescent lamps L1 through Ln in the inverter transformer 5 contained in the backlight device 1. For example, the period of operating time varies to about 20% through 95% by adjusting luminance thereof. Thus, an effective value of heater power of each of the fluorescent lamps L1 through Ln also vary considerably. This applies to the cases described in the above-mentioned Japanese Patent Application Publications.

Further, if a driving control is performed while a heater winding is added to the inverter transformer 5, a discharged current of a main body of the fluorescent lamp and a heater current are mixed so that it is difficult to distinguish between the discharged current and the heater current, which may cause a lamp load current to be incorrectly controlled.

If a heater winding is added to the inverter transformer 5, the transformer for the heater may be omitted. The heaters of the fluorescent lamps may be necessary for pre-heating at a point of starting time of the backlight device as shown in the above-mentioned Japanese Patent Application Publications. Accordingly, during a period of tome about 0.5 to 1 second from a point of power-on time, it may be necessary that only power supply for the heaters of the inverter transformer can output. When such a discharge-starting function that is peculiar to HCFL is provided, the driving control circuit 2 may have an increased control load.

It is desirable to provide fluorescent-lamp-driving device and a liquid crystal display apparatus using the same, which reduces control load of the driving control circuit 2 as compared with the cases of related art, can be downsized and enables the manufacturing costs thereof to be reduced.

According to an embodiment of the present invention, there is provided a fluorescent-lamp-driving device containing a driving control circuit and a transformer.

The driving control circuit receives direct current power voltage from a direct current power supply, receives a lamp control signal for performing drive control on fluorescent lamps, and converts the direct current power voltage to alternating current power voltage having a predetermined frequency for an alternating current power supply.

The transformer contains a winding at a primary side thereof and windings for driving a heater and for maintaining discharge at a secondary side thereof. The winding at the primary side is connected with the alternating current power supply of the driving control circuit. The windings for driving the heater and for maintaining discharge at the secondary side are connected with heaters of the fluorescent lamps at a high electric potential side thereof.

The alternating current power voltage is supplied to the heaters, which are connected with the transformer, of the high electric potential side of the fluorescent lamps. The driving control circuit increases the frequency of the alternating current power supply to a frequency thereof in which voltage of the fluorescent lamps is equal to a discharge start voltage of the fluorescent lamps or less based on the lamp control signal at a period of starting-up time of the fluorescent lamps, thereby limiting output voltage at the secondary side of the transformer below the output voltage thereof at a period of steady operation time of the fluorescent lamps.

In an embodiment of the fluorescent-lamp-driving device according to the invention, the transformer contains the winding at the primary side thereof and windings for driving a heater and for maintaining discharge at the secondary side thereof as well as the winding at the primary side is connected with the alternating current power supply of the driving control circuit and the windings for driving the heater and for maintaining discharge at the secondary side is connected with the fluorescent lamps. The driving control circuit receives the direct current power voltage and the lamp control signal for performing drive control on the fluorescent lamps. The driving control circuit converts the direct current power voltage to the alternating current power voltage having a predetermined frequency for the alternating current power supply. The alternating current power voltage is supplied to the heaters, which are connected with the transformer, of the high electric potential side of the fluorescent lamps.

On the assumption of this, when performing drive control on the fluorescent lamps, the driving control circuit increases the frequency of the alternating current power supply to a frequency in which voltage of the fluorescent lamps is equal to a discharge start voltage of the fluorescent lamps or less based on the lamp control signal at a period of starting-up time of the fluorescent lamps, thereby limiting output voltage at the secondary side of the transformer below the output voltage thereof at a period of steady operation time of the fluorescent lamps. Accordingly, it is possible to prevent the fluorescent lamps from being lighted for a period of pre-heating time (for example, 0.5 to 1 second) from a point of starting-up time of the device to a point of time where a temperature of the fluorescent lamps reaches a pre-heating temperature of the heater.

In the embodiment of the fluorescent-lamp-driving device according to the invention, the transformer containing the windings for driving the heater and for maintaining discharge uses so that providing with the transformers for heaters respectively at a high electric potential side and at a low electric potential side other than a transformer for inverter as related art so as to drive these transformers for heaters separately can be avoided. This enables a space for attaching the transformer to be reduced as compared with a case where the heaters are provided respectively and controlled separately. This also enables control load in the driving control circuit to be reduced. Thus, it is possible to downsize the fluorescent-lamp-driving device and reduce its manufacturing costs.

According to another embodiment of the present invention, there is provided a liquid crystal display apparatus containing a liquid crystal display unit and a backlight device that contains a plurality of fluorescent lamps, each of which irradiates light to the liquid crystal display unit, and drives the fluorescent lamps.

The backlight device contains a driving control circuit that receives direct current power voltage from a direct current power supply, receives a lamp control signal for performing drive control on fluorescent lamps, and converts the direct current power voltage to alternating current power voltage having a predetermined frequency for an alternating current power supply. The backlight device also contains a transformer containing a winding at a primary side thereof and windings for driving a heater and for maintaining discharge at a secondary side thereof. The winding at the primary side is connected with the alternating current power supply of the driving control circuit. The windings for driving the heater and for maintaining discharge at the secondary side are connected with heaters of the fluorescent lamps at a high electric potential side thereof. The alternating current power voltage is supplied to the heaters, which are connected with the transformer, of the high electric potential side of the fluorescent lamps. The driving control circuit increases the frequency of the alternating current power supply to a frequency thereof in which voltage of the fluorescent lamps is equal to a discharge start voltage of the fluorescent lamps or less based on the lamp control signal at a period of starting-up time of the fluorescent lamps, thereby limiting output voltage at the secondary side of the transformer below the output voltage thereof at a period of steady operation time of the fluorescent lamps.

In the embodiment of the liquid crystal display apparatus according to the invention, there is provided with the backlight device containing the embodiment of the fluorescent-lamp-driving device according to the invention so that it is possible to prevent the fluorescent lamps from being lighted for a period of pre-heating time thereof from a point of starting-up time of the liquid crystal display apparatus to a point of time where a temperature of the fluorescent lamps reaches a pre-heating temperature of the heaters thereof.

Thus, the backlight device built-in liquid crystal display apparatus that uses the transformer containing the windings for driving the heater and for maintaining discharge is provided so that providing with the transformers for heaters respectively at a high electric potential side and at a low electric potential side other than a transformer for inverter as the liquid crystal display apparatus of related art so as to drive these transformers for heaters separately can be avoided. This enables a space for attaching the transformer to be reduced as compared with a case where the transformers for the heaters are provided respectively and the heaters are controlled separately. This also enables control load in the backlight device to be reduced. Thus, it is possible to downsize the liquid crystal display apparatus, reduce its weight and reduce its manufacturing costs.

The concluding portion of this specification particularly points out and directly claims the subject matter of the present invention. However, those skilled in the art will best understand both the organization and method of operation of the invention, together with further advantages and objects thereof, by reading the remaining portions of the specification in view of the accompanying drawing(s) wherein like reference characters refer to like elements.

DESCRIPTION OF THE PREFERRED EMBODIMENTS

The following will describe embodiments of fluorescent-lamp-driving device and a liquid crystal display apparatus using the same according to the present invention with reference to the accompanied drawings.

Figure 1:
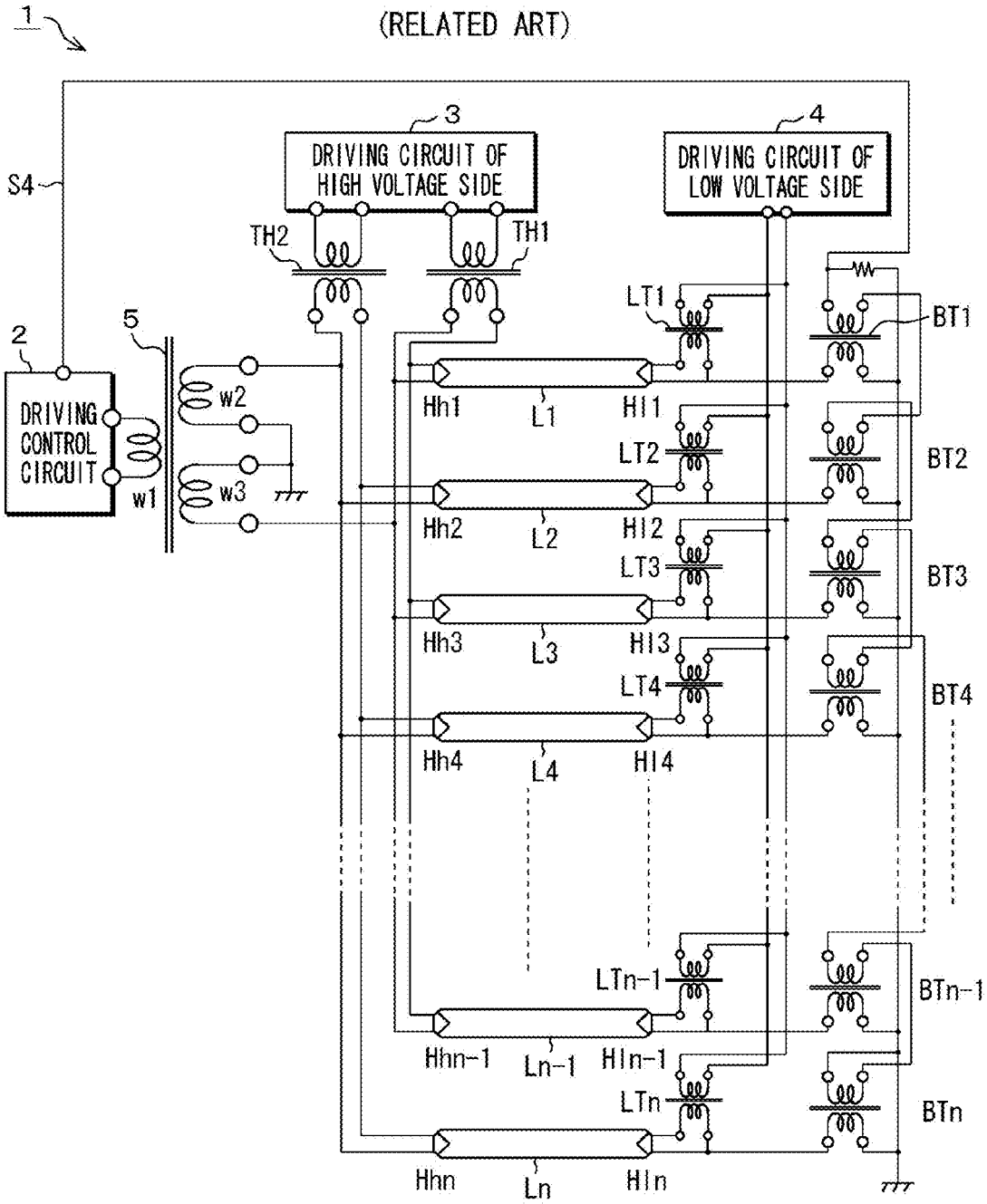
FIG. 1 (RELATED ART)
FIG. 1 is a block diagram showing a configuration of a backlight device of related art.
Figure 2:
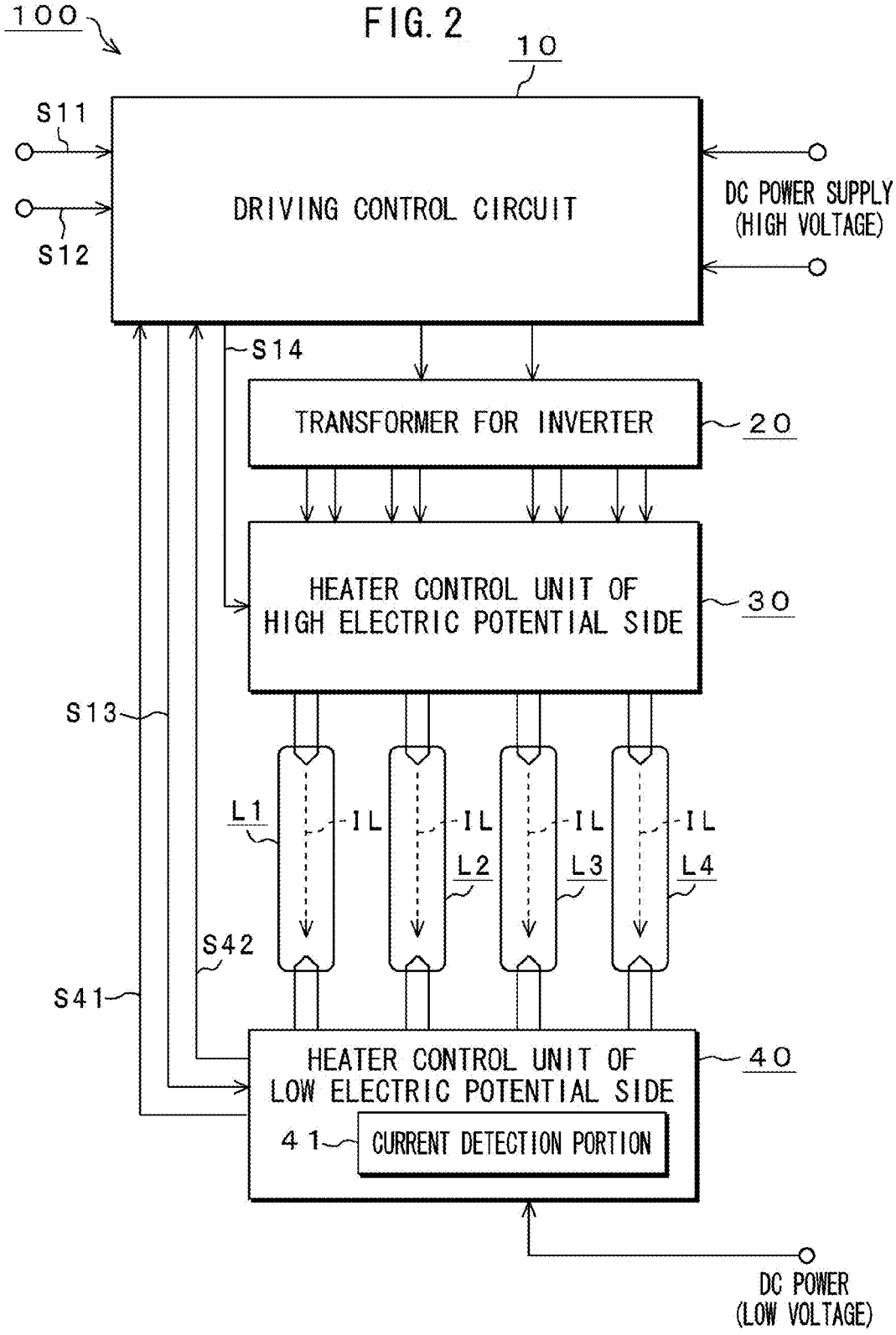
FIG. 2 is a block diagram showing a configuration of a first embodiment of a backlight device 100 according to the invention.
Figure 3:
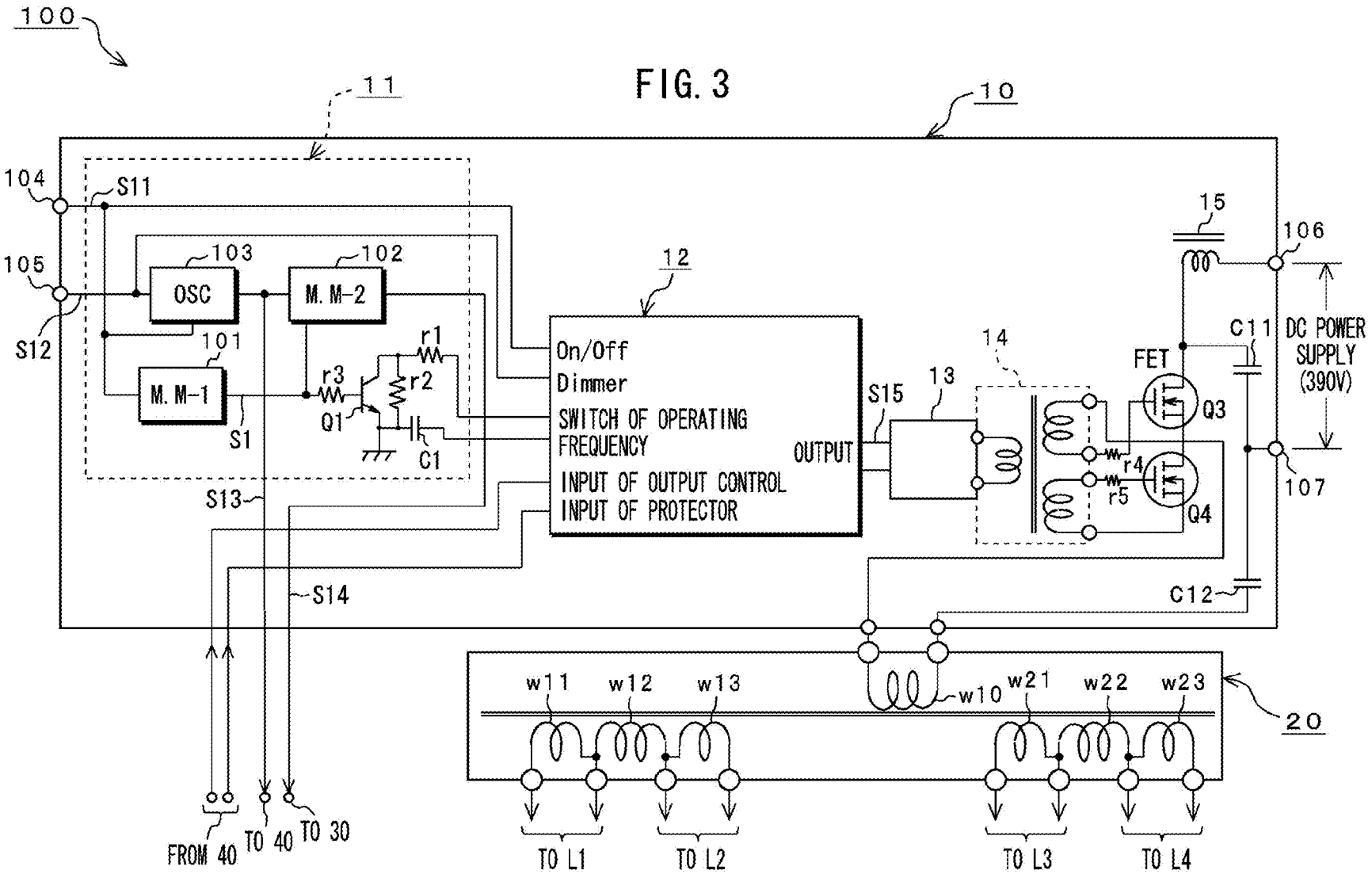
FIG. 3 is a circuit diagram showing an internal configuration of a driving control circuit 10 and a transformer 20 for an inverter.
Figures 4A, 4B:
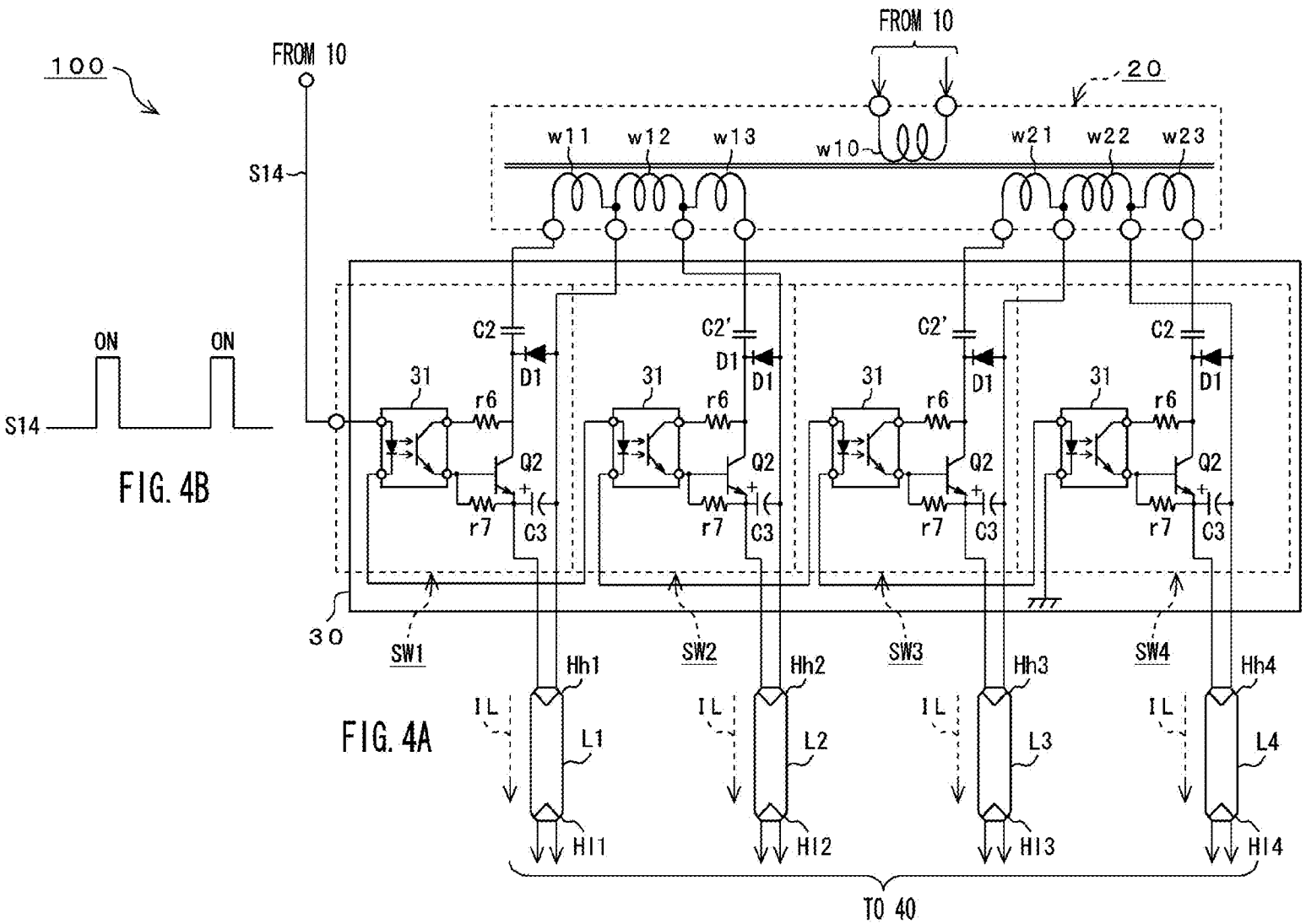
FIG. 4A is a circuit diagram showing an internal configuration of a heater control unit 30 of high electric potential side and FIG. 4B is a diagram showing a driving pulse signal.
Figure 5A:
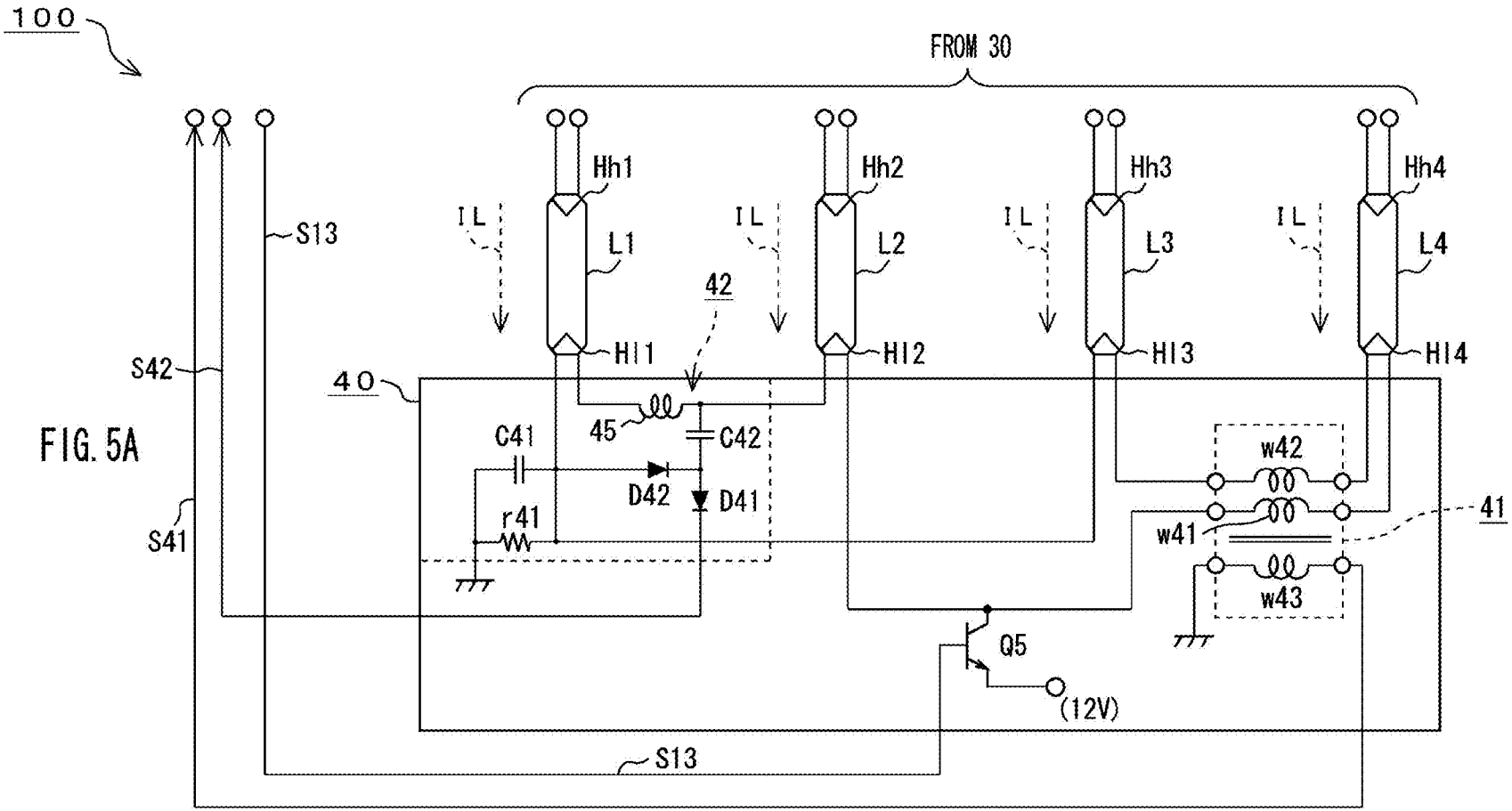
FIG. 5A is a circuit diagram showing an internal configuration of a heater control unit 40 of low electric potential side and FIG. 5B is a diagram showing a driving pulse signal.

FIG. 2 shows a configuration of a first embodiment of a backlight device 100 according to the invention. FIGS. 3, 4A and 5A show internal configurations of respective components thereof.

The backlight device 100 shown in FIG. 2 contains an embodiment of a fluorescent-lamp-driving device according to the invention. The backlight device 100 drives a plurality of hot cathode fluorescent lamps (HCFL) so as to be able to adjust their light. The backlight device 100 may be mounted on a liquid crystal display apparatus, for example, a liquid crystal television set of 40 inches. Normally, such a backlight device uses 12 through 20 pieces of fluorescent lamps, but FIG. 2 shows the backlight device 100 in which four pieces of fluorescent lamps L1 to L4 among them are illustrated for its explanation that is easy to understand.

The backlight device 100, as shown in FIG. 2, contains a driving control circuit 10, a transformer 20 for an inverter, a heater control unit 30 of high electric potential side, a heater control unit 40 of low electric potential side, and the fluorescent lamps L1 to L4. The driving control circuit 10 receives direct current power voltage from a direct current power supply, receives a lamp control signal for performing drive control on the fluorescent lamps L1 to L4, and converts the direct current power voltage to alternating current power voltage having a predetermined frequency for an alternating current power supply. The lamp control signal includes a switch control signal S11 for switching the backlight device 100 on or off and a luminance adjustment signal S12 for adjusting luminance of the fluorescent lamps.

In this embodiment, the driving control circuit 10 increases a frequency (hereinafter, referred to as "operating frequency") of the alternating current power supply to an operating frequency f in which voltage of the fluorescent lamps is equal to a discharge start voltage of the fluorescent lamps or less based on the switch control signal S11 and the luminance adjustment signal S12 at a period of starting-up time of the fluorescent lamps L1 to L4, thereby limiting output voltage at the secondary side of the transformer 20 for the inverter below the output voltage thereof at a period of steady operation time of the fluorescent lamps L1 to L4. For example, when the operating frequency f of the alternating current power supply at a period of starting-up time of the fluorescent lamps L1 to L4 is set to an operating frequency f that is three times to four times of the operating frequency f at a period of steady operation time of the fluorescent lamps L1 to L4, the driving control circuit 10 controls output voltage at the secondary side of the transformer 20 for the inverter so as to be equal to or less than a discharge start voltage of the fluorescent lamps L1 to L4.

The driving control circuit 10 contains, as shown in FIG. 3, a time-limit-setting circuit 11, a driving control IC device 12, a pre-drive circuit 13, a drive transformer 14, n-type field effect transistors (FET; hereinafter, simply referred to as "transistor Q3 and Q4"), capacitors C11 and C12 and an inductor 15. The driving control IC device 12 is provided with respective terminals for On/Off, Dimmer, switch of operating frequency, input of output control, input of protector, and output, which are not shown.

The time-limit-setting circuit 11 contains a first monostable multivibrator (M. M-1; hereinafter, referred to as "timer circuit 101"), a second monostable multivibrator (M. M-2; hereinafter, referred to as "timer circuit 102"), an oscillator 103, an NPN bipolar transistor (hereinafter, simply referred to as "transistor Q1"), three resistors r1 to r3, a capacitor C1, and two input terminal 104 and 105. The time-limit-setting circuit 11 is operated so that when a width of a period of on time in a pulse of the alternating current power voltage at its one cycle is estimated as a period of turning-on time of electricity, the period of turning-on time of electricity for turning on a heater of high voltage side in each of the fluorescent lamps L1 to L4 for a period of pre-heating time is set and the period of turning-on time of electricity for turning on a heater of high voltage side in each of the fluorescent lamps L1 to L4 for a period of steady operation time thereof is set to be shorter than the period of turning-on time of electricity in the period of pre-heating time.

The terminal for On/Off, not shown, of the driving control IC device 12 connects the input terminal 104 to which the switch control signal S11 for switching the backlight device 100 on or off is input. The terminal for Dimmer, not shown, of the driving control IC device 12 connects the input terminal 105 to which the luminance adjustment signal S12 for adjusting luminance of the fluorescent lamps L1 to L4 and the like is input.

The timer circuit 101 connects the input terminal 104 and the oscillator 103 connects the input terminal 104 and the input terminal 105. The oscillator 103 generates a first driving pulse signal S13 based on the switch control signal S11 and outputs it to the heater control unit 40 of low electric potential side. The oscillator 103 outputs the first driving pulse signal S13 with it being in synchronism with the luminance adjustment signal S12.

The driving pulse signal S13 is a control signal for driving a heater of low electric potential side such as the fluorescent lamp L1 and the like (hereinafter, referred to as "heater of low voltage side") and setting a pulse width so that heater voltage of the fluorescent lamps L1 to L4 and the like becomes its target value. The adjustment of luminance of the backlight device 100 is performed on the basis of a ratio of a width of the pulse of a period of the turning-on time of electricity (on time) in a unit cycle and a width of the pulse of a period of the turning-off time of electricity therein, not volume of voltage or current that is supplied to the fluorescent lamps L1 to L4. Discharge load current (hereinafter, referred to as "lamp load current IL") flows through the fluorescent lamps L1 to L4. The lamp load current IL at a point of peak time of the luminance of the fluorescent lamps L1 to L4 is controlled so as to be kept a constant (PWM control).

The timer circuit 101 generates a timer signal S1 based on the switch control signal S11 and outputs it to the timer circuit 102. The timer circuit 101 is connected with the transistor Q1 through the resistor r3 and the timer signal S1 is input to a base of the transistor Q1 through the resistor r3. An emitter of the transistor Q1 is grounded. A collector of the transistor Q1 is connected with the terminal for switch of operating frequency, not shown, of the driving control IC device 12 through the resistor r1 and switches the operating frequency of the transformer 20 for the inverter, which constitutes a transformer.

The collector of the transistor Q1 is grounded through the resistor r2 together with a terminal of the capacitor C1. The other terminal of the capacitor C1 connects the terminal for switch of operating frequency, not shown, of the driving control IC device 12. The capacitor C1 and the resistors r1 and r2 are parts that determine the operating frequency of the transformer 20 for the inverter. When the operating frequency of the transformer 20 for the inverter is f and a constant fixed by the IC used for the driving control circuit 10 or the like is k, the operating frequency f=k/C1*(r1+r2) is held during a period of steady time thereof and the transistor Q1 is switched off. At a period of starting-up time thereof, the operating frequency f=k/C1*r1 is held because the resistor r2 is short-circuited.

The timer circuit 102 connects the above-mentioned oscillator 103 and generates a second driving pulse signal S14 based on the timer signal S1 and the driving pulse signal S13 to output it to a heater control unit 30 of high electric potential side of the fluorescent lamp L1 and the like. The driving pulse signal S14 is a control signal for driving a heater of high electric potential side (hereinafter, referred to as "heater of high voltage side") of the fluorescent lamp L1 and the like. The driving control IC device 12 generates an output control signal S15 based on the operating frequency f=k/C1*r1 after the backlight device 100 has started up.

The output control signal S15 is, for example, a control signal for setting the operating frequency f of the transformer 20 for the inverter only for one second to 200 kHz. It is to be noted that the driving control IC device 12 operates so as to return the operating frequency f of the alternating current power supply at a period of the starting-up time of the fluorescent lamps L1 to L4 to the operating frequency f thereof at a period of steady operation time of the fluorescent lamps L1 to L4 after a period of heater pre-heating time from a point of starting-up time of the fluorescent lamps L1 to L4 to a point of time when temperature of the heaters of the fluorescent lamps L1 to L4 reach their pre-heating temperature has been elapsed. The operating frequency f is returned to the original one thereof because the lamp load current IL at a point of peak time of the luminance of the fluorescent lamps L1 to L4 can be controlled so as to be kept a constant.

The driving control IC device 12 connects the pre-drive circuit 13 which connects the drive transformer 14 for gate control. The pre-drive circuit 13 connects a winding at a primary side of the drive transformer 14 and the windings at a secondary side of the drive transformer 14 connect the transistors Q3 and Q4. The windings at the secondary side of the drive transformer 14 are divided into two windings in order to control the gates of the transistor Q3 and Q4 separately.

A drain of the transistor Q3 connects a terminal 106 of high electric potential side of the direct current power supply (for example, DC 390V) through the inductor 15. The capacitor C11 connects the drain of the transistor Q3 and a terminal 107 of low electric potential side of the direct current power supply. A source of the above-mentioned transistor Q3 connects a drain of the transistor Q4 in series. A connection point of the source of the transistor Q3 and the drain of the transistor Q4 is an output terminal of this driving control circuit and connects a terminal of the winding at a primary side of the transformer 20 for the inverter. A gate of the transistor Q4 connects a terminal of the other winding for gate control of the drive transformer 14 through the resistor r5. The other terminal of the other winding for gate control connects a source of the transistor Q4.

A gate of the transistor Q3 connects a terminal of a winding for gate control of the drive transformer 14 through the resistor r4. The other terminal of the winding for gate control connects a terminal of the winding at a primary side of the transformer 20 for the inverter. A terminal of capacitor C12 connects the above-mentioned terminal 107 of low electric potential side and the other terminal of the capacitor C12 connects the other terminal of the winding at a primary side of the transformer 20 for the inverter.

In the driving control circuit 10 thus configured, the pre-drive circuit 13 excites the drive transformer 14 based on the output control signal S15 and switches on or off the transistors Q3 and Q4 that connect the direct current power supply through the inductor 15. When the transistors Q3 and Q4 are switched on or off, energy accumulated in the inductor 15 charges the capacitors c11 and C12 alternatively and capacitors C11 and C12 are discharged alternatively and these operations are repeated so that alternating current power supply is constituted. The alternating current power supply supplies the winding at a primary side of the transformer 20 for the inverter with alternating current power having a predetermined operating frequency f.

In FIG. 3, the transformer 20 for the inverter that connects the driving control circuit 10 operates so as to supply the fluorescent lamps L1 to L4 with the lamp load current IL. The transformer 20 for the inverter contains a winding w10 for alternating current power supply at its primary side, windings w11, w13, w21 and w23 for driving the heaters at its secondary side and windings w12 and w22 for maintaining discharge at its secondary side. The winding w10 at a primary side thereof connects the alternating current power supply in the driving control circuit 10. Each of the windings w12 and w22 for maintaining discharge has, for example, one thousand turns or more. Each of the windings w11, w13, w21 and w23 for driving the heaters has about ten turns, which is one hundredth of the winding for maintaining discharge.

The luminance adjustment of the above-mentioned fluorescent lamps L1 to L4 is carried out by a user so that it is not constant at all times. When the luminance adjustment of the above-mentioned fluorescent lamps L1 to L4 is carried out, alternating current voltage induced at the windings w11, w13, w21 and w23 for driving the heaters alters. Accordingly, the heater control unit 30 connects (or is provided between) the windings w11, w13, w21 and w23 for driving the heaters in the transformer 20 for the inverter and the heaters Hh1 to Hh4 of high voltage side in the fluorescent lamps L1 to L4 and it converts the alternating current voltage for driving the heaters to direct current to control a period of turning-on time of electricity of the current flown through the heaters Hh1 to Hh4.

In this embodiment, at a period of starting-up time of the fluorescent lamps L1 to L4, the driving control circuit 10 supplies power to the heaters Hh1 to Hh4 of high voltage side in the fluorescent lamps L1 to L4 for a period of turning-on time of electricity that is longer than that of a period of steady operation time of the fluorescent lamps L1 to L4. At the period of steady operation time of the fluorescent lamps L1 to L4, the driving control circuit 10 supplies power to the heaters Hh1 to Hh4 of high voltage side in the fluorescent lamps L1 to L4 only for a period of turning-on time of electricity in which the fluorescent lamps L1 to L4 maintain their minimum luminance or shorter. When voltage is applied to each of the heaters Hh1 to Hh4 of the fluorescent lamps L1 to L4, it satisfies a standard on the heater voltage. This enables the alteration in the heater power at the period of starting-up time of the fluorescent lamps L1 to L4 and at the period of steady operation time of the fluorescent lamps L1 to L4 to be prevented.

In this embodiment, a terminal of the heater Hh1 of high voltage side in the fluorescent lamp L1 connects the winding w11 for driving the heater in the transformer 20 for the inverter as shown in FIG. 4A through the heater control unit 30 of high electric potential side. The other terminal of the heater Hh1 of high voltage side in the fluorescent lamp L1 connects a terminal of the winding w12 for maintaining discharge. A terminal of the heater Hh2 of high voltage side in the fluorescent lamp L2 connects the other terminal of the winding w12 for maintaining discharge. Similarly, the other terminal of the heater Hh2 of high voltage side in the fluorescent lamp L2 connects the winding w13 for driving the heater through the heater control unit 30.

A terminal of the heater Hh3 of high voltage side in the fluorescent lamp L3 connects the winding w21 for driving the heater in the transformer 20 for the inverter through the heater control unit 30 of high electric potential side. The other terminal of the heater Hh3 of high voltage side in the fluorescent lamp L3 connects a terminal of the winding w22 for maintaining discharge. A terminal of the heater Hh4 of high voltage side in the fluorescent lamp L4 connects the other terminal of the winding w22 for maintaining discharge. Similarly, the other terminal of the heater Hh4 of high voltage side in the fluorescent lamp L4 connects the winding w23 for driving the heater through the heater control unit 30.

In this embodiment, power supply for the heaters Hh1 and Hh2 of the fluorescent lamps L1 and L2 or the heaters Hh3 and Hh4 of the fluorescent lamps L3 and L4 is formed so that the winding w12 or w22 for maintaining discharge in the transformer 20 for the inverter is tapped at about ten turns inwardly from a coil-turn-start end thereof and a coil-turn-finishing end thereof and the windings w11 and w13 for driving the heaters or the windings w21 and w23 for driving the heaters are obtained.

The heater control unit 30 contains a switch circuit SW1 for the fluorescent lamp L1 and controls the period of turning-on time of electricity from the direct current power supply to the heater Hh1 of high voltage side based on driving pulse signal S14 shown in FIG. 4B from the timer circuit 102. The switch circuit SW1 contains photo coupler 31, resistors r6 and r7, capacitors C2 and C3, a diode D1 and NPN bipolar transistor (herein, simply referred to as "transistor Q2") which constitutes a full-wave rectification circuit that can control a period of turning-on time of electricity. Thus, the capacitor C2, the diode Di and the transistor Q2 constitute the full-wave rectification circuit because by selecting capacitance of the capacitor C2, the heater power alters.

A terminal of the winding w11 for driving the heater in the transformer 20 for the inverter connects a terminal of the heater Hh1 of high voltage side in the fluorescent lamp L1. The other terminal of the winding w11 connects a collector of the transistor Q2 through the capacitor C2. A base of the transistor Q2 connects a side of light-receiving element of the photo coupler 31. The resistor r6 connects the collector of the transistor Q2 and a collector of the photo coupler 31. The resistor r7 connects an emitter of the transistor Q2 and an emitter of the photo coupler 31.

The capacitor C3 connects a terminal of the heater Hh1 of high voltage, the emitter of the transistor Q2 and the other terminal of the heater Hh1 of high voltage and smoothes pulsating current voltage after the full-wave rectification has been performed. The diode D1 connects the collector of the transistor Q2 and a terminal of the heater Hh1 of high voltage side and performs the full-wave rectification on the alternating current power together with the transistor Q2 during a period of on-operation time of the transistor Q2. Thus, in the switch circuit SW1, a rectification circuit constituted of the capacitor C2, the diode D1 and the transistor Q2 converts voltage induced at the winding w11 for driving the heater to direct current voltage and the capacitor C3 smoothes it.

In this embodiment, if rated effective voltage is supplied to the heater Hh1 of high voltage side, the smoothing capacitor C3 may be omitted. When a period of turning-on time of electricity of the direct current power supply to the heater Hh1 of high voltage side is of 20% of a duty cycle of one pulse, a peak value of peak voltage becomes $\sqrt{5}$ times of rated value thereof. Accordingly, in order to ensure reliability of the heater Hh1 of high voltage side, the capacitor C3 is used so as to allow the peak voltage to be decreased.

It is to be noted that the timer circuit 102 shown in FIG. 3 connects a side of a light-emitting element of the photo coupler 31 which sets the period of turning-on time of electricity from the direct current power supply to the heater Hh1 of high voltage side based on the driving pulse signal S14 from the timer circuit 102 at the period of starting-up time of the backlight device and at a period of steady operation time of the backlight device, respectively. Based on the driving pulse signal S14, the light-emitting element of the photo coupler 31 is switched on at its high level and switched off at its low level as shown in FIG. 4B.

The fluorescent lamp L2 contains a switch circuit SW2. The fluorescent lamp L3 contains a switch circuit SW3. The fluorescent lamp L4 contains a switch circuit SW4. An internal configuration of each of the switch circuits SW2 to SW4 is the same as that of the switch circuit SW1, detailed description of which will be omitted. It is to be noted that capacitance of the capacitor C2 of the switch circuit SW1 is set so as to be different from the capacitance of capacitor C2' of the switch circuit SW2. Capacitance of the capacitor C2' of the switch circuit SW3 is set so as to be different from the capacitance of the capacitor C2 of the switch circuit SW4.

The capacitances are thus differentiated so that no difference occur in the heater power of the fluorescent lamps L1 and L2 at the period of starting-up time of the backlight device and at a period of steady operation time of the backlight device and no difference occur in the heater power of the fluorescent lamps L3 and L4 at the period of starting-up time of the backlight device and at a period of steady operation time of the backlight device. The light-emitting elements of three photo couplers 31 provided inside the respective switch circuits SW2 to SW4 are connected to each other in series together with the light-emitting element of the photo coupler 31 of the switch circuit SW1.

The switch circuits SW2 to SW4 perform control of a turning-on of electricity on the heater Hh2 of high voltage in the fluorescent lamp L2, control of a turning-on of electricity on the heater Hh3 of high voltage in the fluorescent lamp L3 and control of a turning-on of electricity on the heater Hh4 of high voltage in the fluorescent lamp L4 based on the driving pulse signal S14 from the timer circuit 102, at the same time when the switch circuit SW1 performs control of a turning-on of electricity on the heater Hh1 of high voltage in the fluorescent lamp L1 based on the driving pulse signal S14 from the timer circuit 102.

The timer circuit 102 supplies the photo couplers 31 that are connected to each other in series with the driving pulse signal S14 for setting the period of turning-on time of electricity from the direct current power supply to the heater Hh1 of high voltage side so as to become long (100% to 50% of a duty cycle of one pulse) because output voltage of the windings w11, w13, w21 and w23 for driving the heaters is low at the period of starting-up time of the backlight device. At a period of steady operation time of the backlight device, the timer circuit 102 supplies the photo couplers 31 with the driving pulse signal S14 for supplying the heater power to the heaters Hh1 to Hh4 of high voltage side in the fluorescent lamps L1 to L4 only for a period of time that does not exceed a period of turning-on time of electricity when an amount of luminance adjustment (dimmer adjustment) is minimum value, if a period of operation time when the fluorescent lamps L1 to L4 keep their minimum luminance is a period of turning-on time of electricity when the amount of luminance adjustment (dimmer adjustment) is minimum value. This enables an effective value of heater current to satisfy its rating.

In this embodiment, current mixing lamp load current IL flown through each of the fluorescent lamps L1 to L4 and each heater current is flown between the heaters (electrodes) of high electric potential side and low electric potential side in each of the fluorescent lamps L1 to L4. Accordingly, a method is adapted in which only the lamp load current IL of the fluorescent lamps L1 to L4 is extracted and a value of the extracted lamp load current IL becomes a rated value thereof.

The heater control unit 40 of low electric potential side connects the heaters Hl1 to Hl4 of low voltage side in the fluorescent lamps L1 to L4 as shown in FIG. 5A. The heater control unit 40 contains NPN bipolar transistor (hereinafter, simply referred to as "transistor Q5") for controlling the heaters, a current detection portion 41 and an abnormal condition detection circuit 42. The heater control unit 40 of low electric potential side supplies the heaters Hl1 to Hl4 of low voltage side in the fluorescent lamps L1 to L4 with direct current power.

Two pieces of the heaters Hl1 to Hl4 of low voltage side in the fluorescent lamps L1 to L4 are connected to each other in series and the circuits, each of which the two fluorescent lamps are connected to each other in series, are connected in parallel. In this embodiment, a terminal of the heater Hl1 of low voltage side connects a terminal of the heater Hl2 of low voltage side through the abnormal condition detection circuit 42. A terminal of the heater Hl3 of low voltage side connects a terminal of the heater Hl4 of low voltage side through the current detection portion 41. The other terminal of the heater Hl1 of low voltage side and the other terminal of the heater Hl3 of low voltage side are grounded.

Figure 5B:
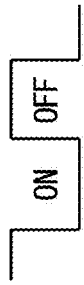

The other terminal of the heater Hl2 of low voltage side and the other terminal of the heater Hl4 of low voltage side connect a collector of the transistor Q5 through the current detection portion 41. Direct current power supply, not shown, connects an emitter of the transistor Q5 and supplies direct current voltage of DC 12V thereto. The driving control circuit 10 shown in FIG. 2 connects a base of the transistor Q5 to which the driving pulse signal S13 output from the time limit circuit 11 is supplied. The transistor Q5 is driven based on the driving pulse signal S13 output from the oscillator 103 of the time limit circuit 11. The driving pulse signal S13 has a fixed cycle and a fixed period of on time as shown in FIG. 5B in order to obtain a predetermined heater power. Based on the driving pulse signal S13, the transistor Q5 is switched off at its high level and switched on at its low level.

According to the backlight device 100, by modulating a pulse width of the driving pulse signal S13 that is supplied to the base of the transistor Q5 as a switching element, the heater voltage is adjusted by switching the period of turning-on time of electricity of the heater current on or off. This enables rated effective current to be controlled so as to flow through the heaters Hl1 to Hl4 of low voltage side. It is to be noted that the transistor Q5 may be omitted in the heater control unit 40 and other appropriate device may be used (resistor is added), which may result in considerably large loss of electric power.

The current detection portion 41 connecting the collector of the above-mentioned transistor Q5 and a terminal of the heater Hl4 of low voltage side in the fluorescent lamp L4 detects the lamp load current flown through the fluorescent lamps L1 to L4 and generates a current detection signal S41. The current detection portion 41 contains a transformer for detecting current. The transformer contains two windings w41 and w42 at its primary side, and at least one winding w43 at its secondary side. The two windings w41 and w42 at the primary side operates so as to cancel a magnetic field generated by the heater current flown through the heaters Hl3 and Hl4 of low voltage side in the fluorescent lamps L3 and L4. A terminal of the winding w43 is grounded and the other terminal thereof connects a terminal (not denoted) for output of control input in the driving control IC device 12.

The current detection portion 41 thus configured cancels output voltage induced at the winding w43 at the secondary side of the transformer in the current detection portion 41 by the heater current so that the heater current is not added to the lamp load current IL and the winding w43 at the secondary side of the transformer in the current detection portion 41 can output only the detection voltage based on the lamp load current IL of the fluorescent lamps L1 to L4 as the current detection signal S41 to the driving control IC device 12.

The abnormal condition detection circuit 42 connecting the heater Hl1 of low voltage side and the heater Hl2 of low voltage side contains capacitors C41 and C42, diodes D41 and D42, resistor r41 and inductor 45 and detects an abnormal condition to generate an abnormal condition detection signal S42 when there occurs the abnormal condition in the lamp load current IL, the heater voltage or the like.

The other terminal of the heater Hl1 of low voltage side is grounded together with the other terminal of the heater Hl3 of low voltage side through the resistor r41 and the capacitor C41 constituting a parallel circuit. A terminal of the capacitor C42 connects a terminal of the heater Hl2 of low voltage side and the other terminal of the capacitor C42 connects a terminal of the diode D41 in series. The other terminal of the diode D41 connects a terminal (not denoted) for protector input in the driving control IC device 12. The diode 42 connects the other terminal of the heater Hl1 of low voltage side and a point of connection in which the capacitor C42 and the diode D41 are connected in series.

In the abnormal condition detection circuit 42, a voltage drop by the resistor r41 alters when the heater current alters. On the other hand, the lamp load current flows through the inductor 45 and alternating current voltage by this lamp load current are converted into direct current voltage by the diodes D41 and D42. A detection voltage in which this direct current voltage and the voltage drop are added is output as the abnormal condition detection signal S42 to the driving control IC device 12.

The driving control IC device 12 compares a value of the detection voltage based on the abnormal condition detection signal S42 with a set standard value. If the value of the detection voltage is the set standard value or more, the operation of the driving control circuit 10 stops.

Figure 6:
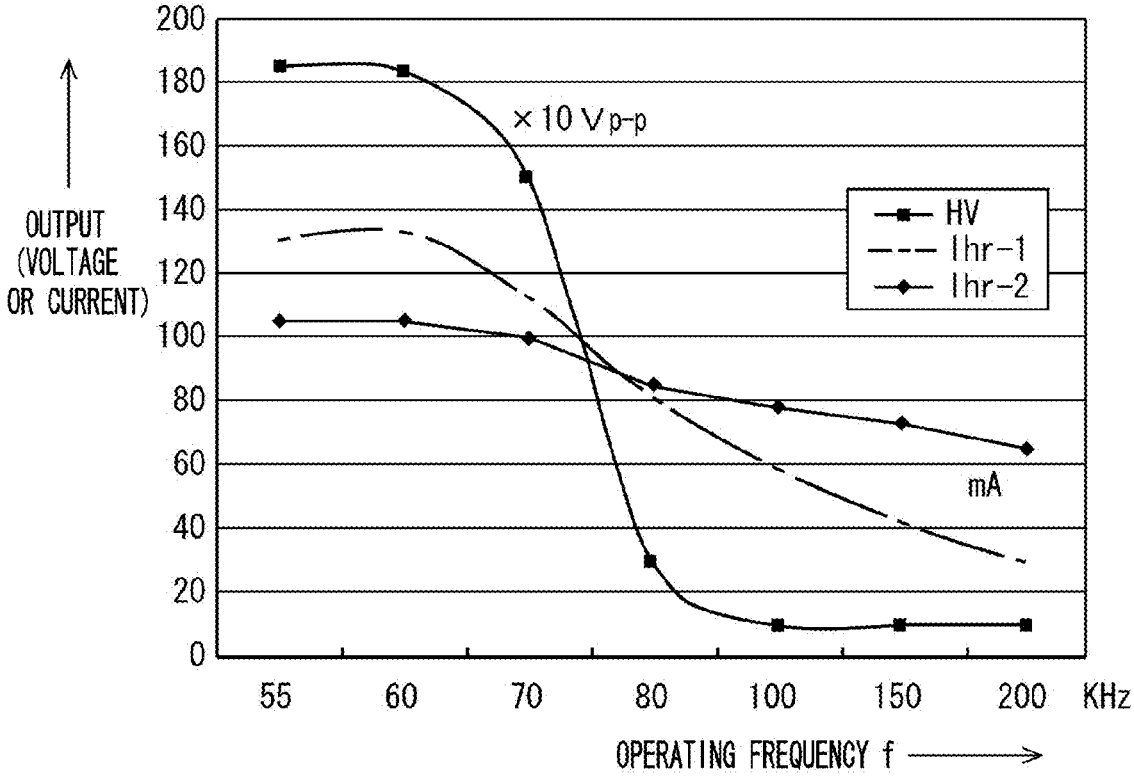
FIG. 6 is a graph showing examples of operating frequency characteristics of the transformer 20 for the inverter.

FIG. 6 shows examples of operating frequency characteristics of the transformer 20 for the inverter in the backlight device 100. A vertical axis of FIG. 6 indicates output (current or voltage), namely, output current Ihr-1 [mA] of the winding w11, output current Ihr-2 [mA] of the winding w13 or output voltage HV [Vp-p] of the winding w12 for maintaining discharge or the like.

A scale of the vertical axis on the output current is read by mA as it is but a scale of the vertical axis on the output voltage is read by multiplying its value by ten. A horizontal axis of FIG. 6 indicates operating frequency f of alternating current power supply of the driving control circuit 10. In FIG. 6, characteristic of the output current Ihr-1 is indicated by alternate long and short dash lines. Characteristic of the output current Ihr-2 is indicated by solid line. Characteristic of the output voltage HV is also indicated by solid line. These characteristics of the output current Ihr-1, the output current Ihr-2 and the output voltage HV constitute the operating frequency characteristics of the transformer 20 for the inverter.

In this embodiment, the output voltage appeared at each of the windings w12, w22 for maintaining discharge of secondary side of the transformer 20 for the inverter is HV, so that the output voltage HV has an electric potential which supplies the fluorescent lamps L1 to L4 with the lamp load current IL. According to the examples of the characteristic of the output voltage HV at the secondary side of the transformer 20 for the inverter as shown in FIG. 6, the output voltage HV at the secondary side thereof is about 1850 Vp-p within a range of the operating frequency f from 55 kHz to 60 kHz.

The output voltage HV at the secondary side thereof is 100 Vp-p within a range of the operating frequency f from 100 kHz to 200 kHz. The output voltage HV at the secondary side thereof is 100 Vp-p<HV<1850 Vp-p within a range of the operating frequency f from 60 kHz to 100 kHz. Thus, the output voltage HV has a curve that is large at the vicinity of the operating frequency f of 55 kHz, which is normal operating frequency, and is near zero at the operating frequency f of 150 kHz or more.

In this embodiment, a curve of operating frequency characteristic relating to the characteristics of the output current Ihr-1 of the winding w11, the characteristic of the output current Ihr-2 of the winding w13 or the like changes based on a tapped position of the winding w11 or w13 for driving the circuit heater in the transformer 20 for the inverter. For example, the characteristic of the output current Ihr-1 of the winding w11 for driving heater indicates a value of the heater current flown through the heater Hh1 of high voltage side in the fluorescent lamp L1 shown in FIG. 3 with respect to the operating frequency f.

According to the characteristic of the output current Ihr-1, even at the operating frequency f of 150 kHz or more, output current is about one third of the output current at the operating frequency f of 55 kHz. When, however, the time limit circuit 11 built-in the timer circuit 102 is added, it is possible to supply only the peak power to the fluorescent lamp L1 at the operating frequency f of 150 kHz or more.

Similarly, the characteristic of the output current Ihr-2 of the winding w13 for driving heater indicates a value of the heater current flown through the heater Hh2 of high voltage side in the fluorescent lamp L2 with respect to the operating frequency f. According to the characteristic of the output current Ihr-2, even at the operating frequency f of 150 kHz or more, output current is about three fourth of the output current at the operating frequency f of 55 kHz. However, similar to the above, it is possible to supply only the peak power to the fluorescent lamp L2 at the operating frequency f of 150 kHz or more. Similarly, it is possible to supply only the peak power to the fluorescent lamps L3 and L4.

In this embodiment, each of the windings w12 and w22 for maintaining discharge at a secondary side has one thousand turns or more, which are considerable many turns, and a resonance operating frequency f0 including capacitance of the fluorescent lamps L1 to L4 is set to the vicinity of 55 kHz. Each of the windings w11, w13, w21 and w23 for driving heaters has one hundredth turns of the turns of each of the windings w12 and w22 for maintaining discharge, so that there is no resonance point at the vicinity of 55 kHz, thereby resulting in a small change in the output voltage HV. When such a frequency characteristic of the transformer 20 for the inverter in which the resonance point is shifted is utilized, the frequency characteristic thereof is available for pre-heating the heaters Hh1 to Hh4 of high voltage side in the fluorescent lamps L1 to L4 at a period of starting-up time of the backlight device 100. A period of time for pre-heating the heaters Hh1 to Hh4 of high voltage side (hereinafter, referred to as "heater pre-heating time") is normally one second or shorter.

Figures 7A, 7B, 7C:
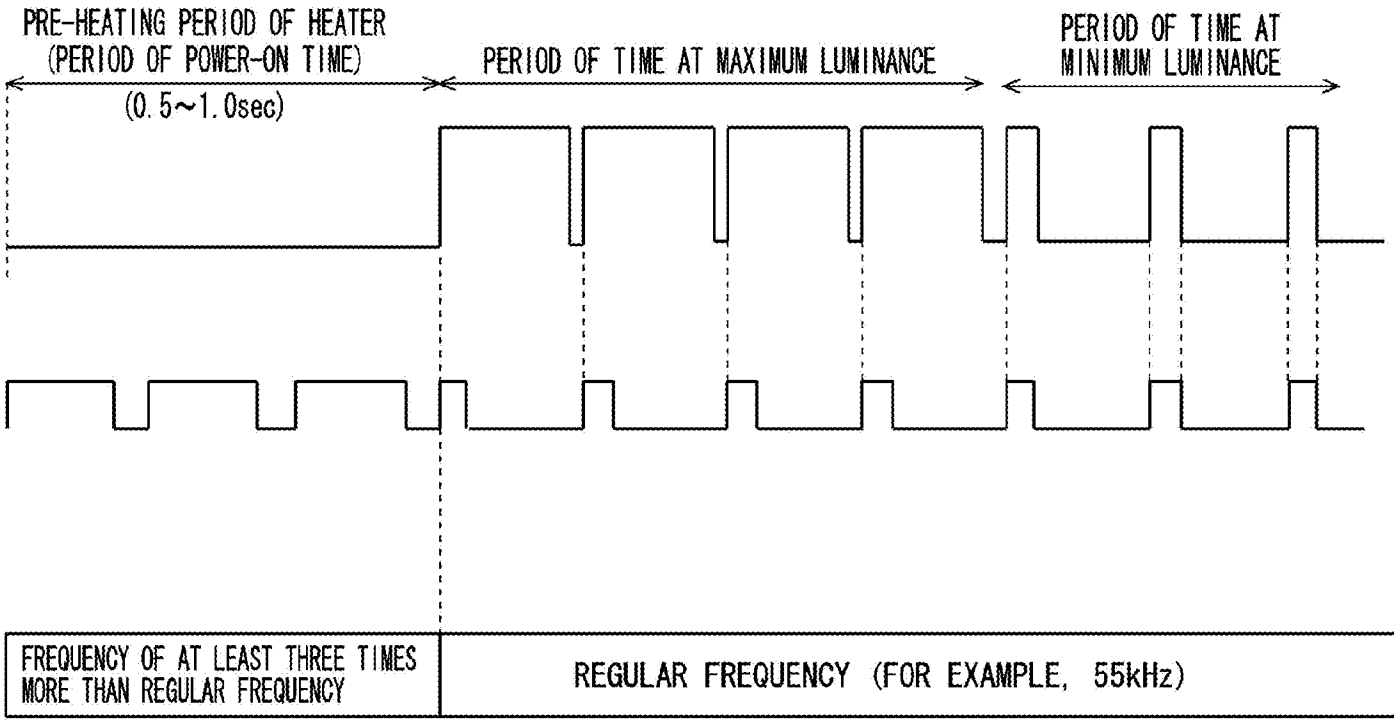
FIGS. 7A through 7C are timing charts each for indicating operation example of the backlight device 100.

The following will describe an operation example of the backlight device 100. FIGS. 7A through 7C respectively show the operation example of the backlight device 100. In this example, the operating frequency f of alternating current power supply (supplied power to the heaters) to the winding w10 at the primary side of the transformer 20 for the inverter is increased, at a period of starting-up time of the backlight device 100, more than the operating frequency f thereof at a period of steady operation time of the backlight device 100 so that a ratio of the voltage at the primary side of the transformer 20 for the inverter, which includes fluorescent lamp circuit at secondary side thereof, and the voltage at the secondary side thereof becomes one fifth or less of that of the period of steady operation time of the backlight device 100.

On the assumption of this, at a period of starting-up time of the backlight device 100, for the heater pre-heating time (from 0.5 second to one second) from a point of power-on time, the operating frequency f of the transformer 20 for the inverter is set to a frequency of at least three times more than regular frequency as shown in FIG. 7C. For example, the operating frequency f of the alternating current power supply is increased to around the operating frequency F=150 kHz so that the voltage of the fluorescent lamps L1 to L4 becomes its discharge start voltage or less. Since the discharge stops during the heater pre-heating time, the lamp load current IL shown in FIG. 7A is not flown. FIG. 7B shows the driving pulse signal S14 to the heater Hh1 of high voltage side or the like. During the heater pre-heating time, a pulse width of the driving pulse signal S14 at high level thereof is set so as to become longer than that of the driving pulse signal S14 at low level thereof.

At this time, in the switch circuit SW1 shown in FIG. 4A, the switching transistor Q2 controls the period of turning-on time of electricity of the direct current power supply to the heater Hh1 of high voltage side through the photo coupler 31. For example, the light-emitting element of the photo coupler 31 sets the period of turning-on time of electricity of the direct current power supply to the heater Hh1 of high voltage side at a period of starting-up time of the backlight device 100 based on the driving pulse signal S14 from the timer circuit 102. Based on the driving pulse signal S14, the light-emitting element of the photo coupler 31 is switched on at its high level and switched off at its low level, as shown in FIG. 7B. The switch circuits SW2 through SW4 operate similar to that of the switch circuit SW1.

This enables the lamp load current of the windings w12 and w22 for maintaining discharge at the secondary side of the transformer 20 for the inverter to be decreased so that the voltage of the fluorescent lamps L1 to L4 becomes its discharge start voltage or less, thereby enabling rated heater voltage to be obtained at the windings w11, w13 and the like with the operating frequency f of the transformer 20 for the inverter being increased.

At a period of steady operation time of the backlight device 100, the operating frequency f shown in FIG. 7C is set to the regular frequency and in the driving pulse signal S14, regardless of maximum luminance adjustment and minimum luminance adjustment, as shown in FIG. 7B, a pulse width of the driving pulse signal S14 at its high level is set so as to be narrower than that of the period of starting-up time of the backlight device 100. The switch circuit SW1 switches the light-emitting element of the photo coupler 31 on at its high level and switches the light-emitting element of the photo coupler 31 off at its low level. The light-emitting element of the photo coupler 31 receives the driving pulse signal S14 having a pulse width at a period of steady operation time of the backlight device 100 from the timer circuit 102 and sets the period of turning-on time of electricity from the direct current power supply to the heater Hh1 of high voltage side based on this driving pulse signal S14. The switch circuits SW2 to SW4 performs the same operation as that of the switch circuit SW1.

Thus, the lamp load current IL shown in FIG. 7A flows from the high electric potential side of the fluorescent lamp L1 or the like to the low electric potential side thereof. At a period of maximum luminance adjustment time, by PWM control based on the driving pulse signal S13 shown in FIG. 5B, the pulse width of the lamp load current IL at high level is considerably longer than the pulse width thereof at low level. This enables the fluorescent lamps L1 to L4 to blaze brightly. At a period of minimum luminance adjustment time, by PWM control based on the driving pulse signal S13 shown in FIG. 5B, the pulse width of the lamp load current IL at high level is considerably shorter than the pulse width thereof at low level. This enables the fluorescent lamps L1 to L4 to blaze less brightly as compared with that of the period of maximum luminance adjustment time.

Thus, in the embodiment of the backlight device according to the invention, when four fluorescent lamps L1 to L4 are controlled and driven, the driving control circuit 10 increases the operating frequency f of the alternating current power supply to about the operating frequency f=150 kHz in which the voltage of the fluorescent lamps L1 to L4 is their discharge start voltage or less based on the switch control signal S11 and the luminance adjustment signal S12 at a period of starting-up time of the backlight device 100. This enables the output voltage HV at the secondary side of the transformer 20 for the inverter to be decreased below the output voltage thereof at a period of steady operation time of the backlight device 100.

Accordingly, it is possible to control the fluorescent lamps L1 to L4 not so as to light them for the heater pre-heating time (for example, 0.5 second to 1 second) from the starting-up of the backlight device 100 to a point of time when the temperature of the fluorescent lamps L1 to L4 reaches the pre-heated temperature of the heaters. This enables to be assembled the backlight device 100 using the transformer 20 for the inverter with the windings w11 to w13, w21 to w23 for driving heaters and for maintaining discharge, thereby avoiding providing the transformers for heaters at a high electric potential side and at a low electric potential side, respectively, other than the transformer for the inverter as related art and controlling these transformers for heaters separately. Accordingly, it is possible to reduce a space for attaching the device as compared with a case where the transformers for heaters are respectively provided and these transformers for heaters are separately controlled. This also enables control load in the driving control circuit to be reduced. Thus, it is possible to downsize the backlight device 100 and reduce its manufacturing costs.

Although a case where the heater power is supplied to the heaters Hh1 to Hh4 of high voltage side of the fluorescent lamps L1 to L4 for the same period of turning-on time of electricity has been described, this invention is not limited to this. By set different periods of turning-on time of electricity based on the tapped position of the windings w11, w13 and the like for driving heater of the transformer 20 for the inverter to supply the heater power to them, the backlight device may be configured so that the heater effective voltages of them are the same value. In this case, the rectification circuits of the switch circuits SW1 to SW4 are simplified but the timer circuits of two systems may be necessary therefore.

Figure 8:
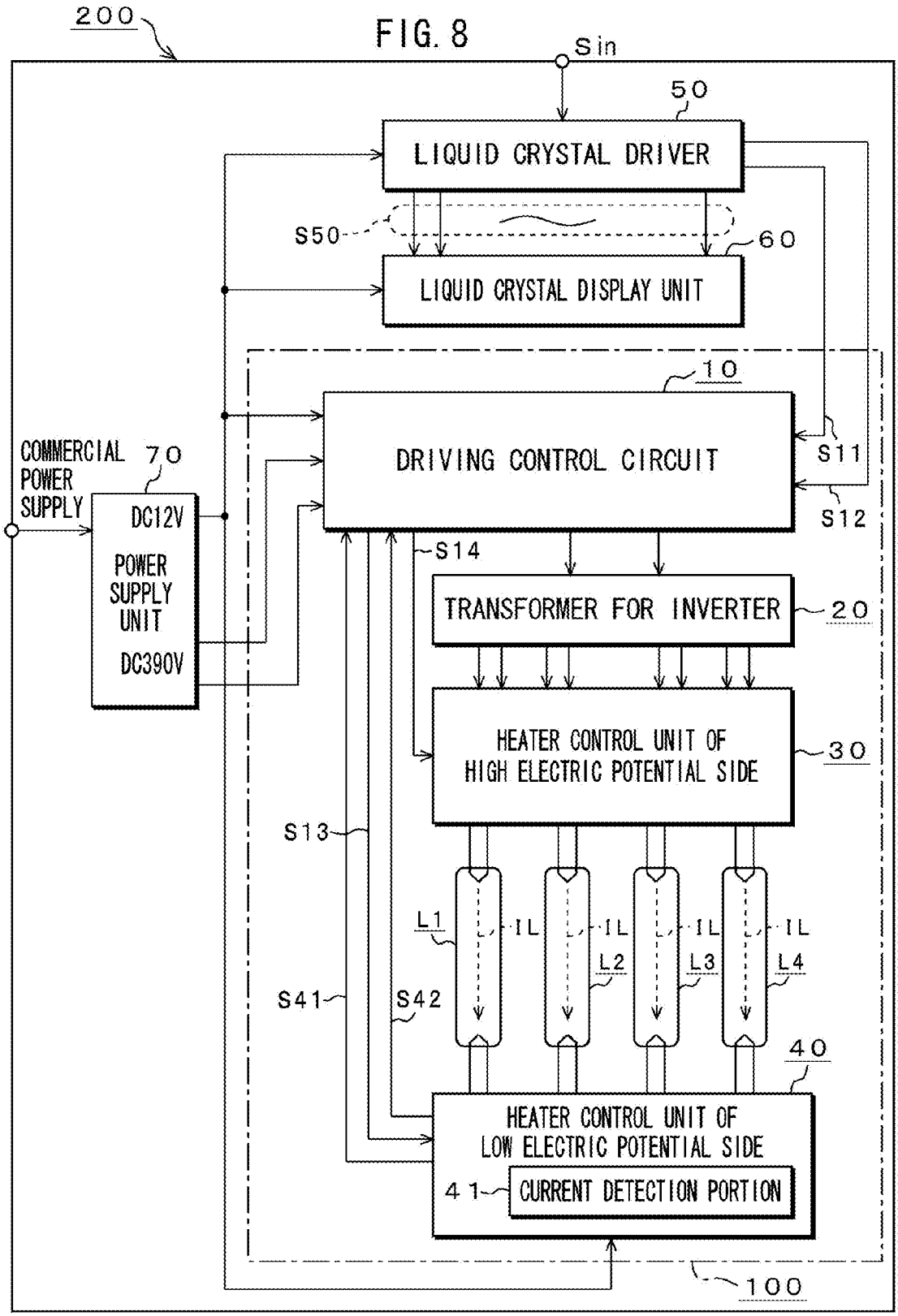
FIG. 8 is a block diagram showing a configuration of a second embodiment of a liquid crystal display apparatus 200 according to the invention.

FIG. 8 shows a configuration of a second embodiment of a liquid crystal display apparatus 200 according to the invention. The liquid crystal display apparatus 200 shown in FIG. 8 contains a liquid crystal driver 50, a liquid crystal display unit 60, a power supply unit 70 and an embodiment of the backlight device 100 according to the invention. In the liquid crystal display apparatus 200, light is irradiated to the liquid crystal display unit 60 uniformly.

The power supply unit 70 connects a commercial power supply of, for example, 100V. The power supply unit 70 mounts a power supply circuit, not shown, for converting the commercial power to two species of direct current voltages of high and low voltages. In this embodiment, the power supply circuit for low voltage converts the commercial power to direct current voltages of 12V by performing full-wave rectification on the commercial power. Similarly, the power supply circuit for high voltage converts the commercial power to direct current voltages of 390V. The power supply unit 70 also connects the driving control circuit 10, the liquid crystal driver 50 and the liquid crystal display unit 60.

The power supply unit 70 supplies the heater control unit 40 of low voltage side, the liquid crystal driver 50 and the liquid crystal display unit 60 with the direct current voltage of 12V and supplies the driving control circuit 10 with the direct current voltage of 390V. The liquid crystal driver 50 receives an image signal Sin and the direct current voltage of 12V and generates a liquid crystal driving signal S50. The liquid crystal driving signal S50 is output to matrix electrodes, not shown, constituting the liquid crystal display unit 60. The liquid crystal driver 50 connects the liquid crystal display unit 60 and receives the direct current voltage of 12V and the liquid crystal driving signal S50 to drive the liquid crystal.

The backlight device 100 is provided on back surface of the liquid crystal display unit 60. The backlight device 100 is constituted by combining the four pieces of fluorescent lamps L1 to L4 and an embodiment of the fluorescent-lamp-driving device according to the invention, as described in the first embodiment. The backlight device 100 drives the four pieces of fluorescent lamps L1 to L4 to irradiate light to the liquid crystal display unit 60 uniformly. As the fluorescent lamps L1 to L4, HCFL is used.

The backlight device 100 connected with the above-mentioned power supply unit 70 drives the four pieces of fluorescent lamps L1 to L4 so that the four pieces of fluorescent lamps L1 to L4 that are connected with the transformer 20 for the inverter have constant luminance. The backlight device 100 contains the driving control circuit 10, the transformer 20 for the inverter, the heater control unit 30 of high voltage side and the heater control unit 40 of low voltage side in addition to the four pieces of fluorescent lamps L1 to L4.

The driving control circuit 10 receives switch control signal S11 for driving and controlling the four pieces of fluorescent lamps L1 to L4, the luminance adjustment signal S12 and direct current voltage of 390V and converts the direct current voltage to alternating current voltage having a predetermined operating frequency f. The transformer 20 for the inverter contains a winding w10 for alternating current power supply at its primary side, windings w11, w12, w13, w21, w22 and w23 for driving the heaters and maintaining discharge at its secondary side. The winding w10 connects the alternating current power supply in the driving control circuit 10. The heaters Hh1 and Hh2 of the fluorescent lamps L1 and L2 connect the winding w11, w12 and w13 for driving the heaters and maintaining discharge and the heaters Hh3 and Hh4 of the fluorescent lamps L3 and L4 connect the winding w21, w22 and w23 for driving the heaters and maintaining discharge (see FIG. 3).

The direct current voltage of 12V is supplied to the heaters Hl1 to Hl4 of the fluorescent lamps L1 to L4 connected to the transformer 20 for the inverter (see FIG. 5A). The driving control circuit 10 increases the operating frequency f, 55 kHz, of the alternating power supply at a period of steady operation time of the fluorescent lamps L3 and L4 to an operating frequency f thereof, in which the voltage of the fluorescent lamps L3 and L4 is discharge start voltage or smaller, at a period of starting-up time of the fluorescent lamps L3 and L4 based on the switch control signal S11 and the luminance adjustment signal S11. This enables the output voltage of the transformer 20 for the inverter at its secondary side to be decreased as compared with the voltage at the period of steady operation time of the fluorescent lamps L3 and L4 (see FIG. 7). Thus, the backlight device 100 converts the direct current voltage of 390V to alternating voltage to drive the four pieces of fluorescent lamps L1 to L4 by alternating current voltage.

Since the liquid crystal display apparatus 200 as the second embodiment is provided with the backlight device 100, for the heater pre-heating time from a point of power-on time of the liquid crystal display apparatus 200 to a point of time when temperature of the fluorescent lamps L1 to L4 reach their pre-heating temperature, it is possible to avoid lighting the fluorescent lamps L1 to L4.

Accordingly, the liquid crystal display apparatus 200 that mounts the backlight device 100 using the transformer 20 for the inverter with the windings w11, w12, w13, w21, w22 and w23 for driving heaters and for maintaining discharge can be presented, thereby avoiding providing the transformers for heaters at a high electric potential side and at a low electric potential side, respectively, other than the transformer for the inverter as related art and controlling these transformers for heaters separately.

Accordingly, it is possible to reduce a space for attaching the transformer for heaters as compared with a case where the transformers for heaters are respectively provided and these transformers for heaters are separately controlled. This also enables driving control load in the backlight device 100 to be reduced. Thus, it is possible to downsize the liquid crystal display apparatus 200 such as a large-size liquid crystal television set or a large-size liquid crystal monitor and reduce its manufacturing costs.

This invention is preferably applied to backlight device driving a plurality of hot cathode fluorescent lamps and a liquid crystal display apparatus or the like using the backlight device.

It should be understood by those skilled in the art that various modifications, combinations, sub-combinations and alternations may occur depending on design requirements and other coefficients insofar as they are within the scope of the appended claims or the equivalents thereof.

The present application contains subject matter related to that disclosed in Japanese Priority Patent Application JP 2008-092844 filed in the Japanese Patent Office on Mar. 31, 2008, the entire contents of which is hereby incorporated by reference.

What is claimed is:

1. A fluorescent-lamp-driving device comprising:

a driving control circuit that receives direct current power voltage from a direct current power supply, receives a lamp control signal for performing drive control on fluorescent lamps, and converts the direct current power voltage to alternating current power voltage having a predetermined frequency for an alternating current power supply; and a transformer containing a winding at a primary side thereof and windings for driving a heater and for maintaining discharge at a secondary side thereof, the winding at the primary side being connected with the alternating current power supply of the driving control circuit, and the windings for driving the heater and for maintaining discharge at the secondary side being connected with heaters of the fluorescent lamps at a high electric potential side thereof, wherein the alternating current power voltage is supplied to the heaters, which are connected with the transformer, of the high electric potential side of the fluorescent lamps; and wherein the driving control circuit increases the frequency of the alternating current power supply to a frequency thereof in which a voltage of the fluorescent lamps is equal to a discharge start voltage of the fluorescent lamps or less based on the lamp control signal at a period of starting-up time of the fluorescent lamps, thereby limiting an output voltage at the secondary side of the transformer below the output voltage thereof at a period of steady operation time of the fluorescent lamps.

2. The fluorescent-lamp-driving device according to claim 1 wherein when an operating frequency of the alternating current power supply at the period of starting-up time of the fluorescent lamps is set to an operating frequency that is three times to four times of the operating frequency at the period of steady operation time of the fluorescent lamps, the driving control circuit controls output voltage at the secondary side of the transformer so to be equal to or less than the discharge start voltage of the fluorescent lamps.

3. The fluorescent-lamp-driving device according to claim 2 wherein when the operating frequency of the alternating current power supply in the driving control circuit is f and the output voltage of the windings for maintaining discharge at the secondary side of the transformer is HV, the transformer connecting the driving control circuit outputs the output voltage HV of the windings for maintaining discharge at the secondary side of the transformer of about 1850 Vp-p (peak-to-peak Voltage) within a range of the operating frequency, f, from 55 kHz to 60 kHz, outputs the output voltage HV of the windings for maintaining discharge at the secondary side of the transformer of 100 Vp-p within a range of the operating frequency, f, from 100 kHz to 200 kHz, and outputs the output voltage HV of the windings for maintaining discharge at the secondary side of the transformer of 100 Vp-p<HV<1850 Vp-p within a range of the operating frequency, f, from 60 kHz to 100 kHz.

4. The fluorescent-lamp-driving device according to claim 3 wherein the driving control circuit return the operating frequency of the alternating current power supply at the period of the starting-up time of the fluorescent lamps to the operating frequency thereof at the period of steady operation time of the fluorescent lamps after a period of heater pre-heating time from a point of starting-up time of the fluorescent lamps to a point of time when temperature of the heaters of the fluorescent lamps reach their pre-heating temperature has been elapsed.

5. The fluorescent-lamp-driving device according to claim 4 wherein the driving control circuit is operated so that when a width of a period of on time in a pulse of the alternating current power voltage at its one cycle is estimated as a period of turning-on time of electricity, the period of turning-on time of electricity for turning on a heater of high voltage side in each of fluorescent lamps L1 to L4 for the period of pre-heating time is set and the period of turning-on time of electricity for turning on the heater of high voltage side in each of the fluorescent lamps L1 to L4 for the period of steady operation time thereof is set to be shorter than the period of turning-on time of electricity in the period of pre-heating time.

6. The fluorescent-lamp-driving device according to claim 5 wherein a heater control unit connects the windings for driving heaters at the secondary side of the transformer and the heaters of high voltage side in the fluorescent lamps;

wherein the heater control unit supplies the heaters of high voltage side in the fluorescent lamps with power for the period of turning-on time of electricity that is longer than the period of turning-on time of electricity at the period of steady operation time of the fluorescent lamps at the period of starting-up time of the fluorescent lamps; and wherein the heater control unit supplies the heaters of high voltage side in the fluorescent lamps with power only for the period of turning-on time of electricity in which the fluorescent lamps maintain minimum luminance thereof or shorter at the period of steady operation time of the fluorescent lamps.

7. The fluorescent-lamp-driving device according to claim 1 further comprising a circuit that supplies power to the heaters of low electric potential side in the fluorescent lamps, wherein the circuit includes a current detection portion that detects discharge load current flowing the fluorescent lamps.

8. The fluorescent-lamp-driving device according to claim 7 wherein the current detection portion contains a transformer for detecting current;

wherein the transformer contains two windings at its primary side and at least one winding at its secondary side; and wherein the two windings at the primary side operates so as to cancel a magnetic field generated by the current flowing through the heaters of low electric potential side in the fluorescent lamps.

9. A liquid crystal display apparatus comprising:

a liquid crystal display unit; and a backlight device that contains a plurality of fluorescent lamps, each of which irradiates light to the liquid crystal display unit, and drives the fluorescent lamps, wherein the backlight device contains:

a driving control circuit that receives direct current power voltage from a direct current power supply, receives a lamp control signal for performing drive control on the fluorescent lamps, and converts the direct current power voltage to alternating current power voltage having a predetermined frequency for an alternating current power supply; and a transformer containing a winding at a primary side thereof and windings for driving a heater and for maintaining discharge at a secondary side thereof, the winding at the primary side being connected with the alternating current power supply of the driving control circuit, and the windings for driving the heater and for maintaining discharge at the secondary side being connected with heaters of the fluorescent lamps at a high electric potential side thereof, wherein the alternating current power voltage is supplied to the heaters, which are connected with the transformer, of the high electric potential side of the fluorescent lamps; and wherein the driving control circuit increases a frequency of the alternating current power supply to a frequency thereof in which voltage of the fluorescent lamps is equal to a discharge start voltage of the fluorescent lamps or less based on the lamp control signal at a period of starting-up time of the fluorescent lamps, thereby limiting output voltage at the secondary side of the transformer below the output voltage thereof at a period of steady operation time of the fluorescent lamps.

* * * * *